United States Patent [19]

Jones

[11] 4,368,903

[45] Jan. 18, 1983

[54] TEAR-OFF POSTAL RECEIPT FORM

[75] Inventor: John H. Jones, Westfield, N.J.

[73] Assignee: Beatrice Foods Co., Chicago, Ill.

[21] Appl. No.: 164,329

[22] Filed: Jun. 30, 1980

[51] Int. Cl.[3] ..... B65D 65/28; G09F 3/00

[52] U.S. Cl. ..... 283/21; 156/289; 229/73; 428/43

[58] Field of Search ..... 283/5, 60 A, 21, 18, 283/20; 229/70, 73, 92.8, 72, 74, 76; 428/42, 43, DIG. 914; 156/248, 249, 253, 289; 40/594

[56] References Cited

U.S. PATENT DOCUMENTS

| | | | |
|---|---|---|---|
| 1,239,977 | 9/1917 | Small | 283/21 |
| 2,321,184 | 6/1943 | Butterworth | 283/21 |
| 2,910,222 | 10/1959 | Bermingham | 229/73 |
| 3,126,211 | 3/1964 | Hieken et al. | 283/6 |
| 3,802,618 | 4/1974 | Wiessner | 229/73 |
| 3,925,585 | 12/1975 | Aoyagi | 283/18 X |
| 3,942,714 | 3/1976 | Wise | 229/73 |

*Primary Examiner*—Paul A. Bell
*Assistant Examiner*—John S. Brown
*Attorney, Agent, or Firm*—Shlesinger, Arkwright, Garvey & Dinsmore

[57] ABSTRACT

A tear-off return receipt form for attachment to a mail support surface comprising a base member including a marginal strip and a main strip, a top member including a marginal strip and a main strip, the marginal and main strips each having inside and outside surfaces, the outside main surfaces having printing thereon, the base and top members including the margin and main strips being substantially coextensive with each other, one of the members having adhesive on its inside margin surface, one of the members having adhesive on its inside main surface, the other of the members having a release coat on its inside margin surface cooperating with the adhesive on the other of the members inside margin surface, the inside main surface of one of the members being adhesively bonded to the inside main surface of the other of the members to form a postal return receipt having margin securing means, means on the other of the members to permit its margin strip to be peeled away to expose the adhesive on the one of the members inside margin surface so that the exposed adhesive will secure the postal return receipt to said mail support surface and tear means on the margin strip for permitting separation of the postal return receipt from the mail support surface.

6 Claims, 7 Drawing Figures

TEAR-OFF POSTAL RECEIPT FORM

This invention relates to a tear-off postal return receipt form for attachment to a mail support surface such as used in the U.S. Post Office for certified mail or the like in which the form is returned to sender after having been removed from the object which was shipped.

HISTORICAL BACKGROUND

The present postal receipt forms which are available and identified primarily as postal form PS Form 3811 April 1977 are made of a cardboard member having marginal edges which have applied thereto pressure sensitive adhesive and include a pair of release strips applied to either of the edges for exposing the adhesive when the form is to be applied to a package envelope or the like.

The present form is expensive to manufacture requiring especial equipment as well as very expensive release strips. The equipment for making the present form has to be specially designed and has little use for other applications in the printing and form manufacturing business.

OBJECTS AND SUMMARY OF THE INVENTION

It is therefore an object of this invention to provide a postal return receipt form which can be made cheaply on standard machinery.

Another object of this invention is to provide a postal receipt form which can be made up from standard stock and does not require expensive release paper for application to the pressure sensitive adhesive now being used on standard forms.

A further object of this invention is to provide a tear-off postal return receipt form which eliminates the problem of having the release strips fall off thus destroying the form prior to its use because the adhesive of the form once the release strip is removed will engage another surface and prevent further application of the form.

Still a further object of this invention is to provide a tear-off postal return receipt form which can be made up by laminating several inexpensive pieces of sheet material together to provide sufficient thickness to come up to the stiffness of present forms.

In summary, therefore this invention is directed to a postal return receipt form which can be readily substituted for present postal receipt forms for the purpose of reducing costs and expense as well as the minimum of problems encountered in use or storage including losses due to damage to forms prior to use. These and other objects of this invention will be apparent from the following description and claims.

In the accompanying drawings which by way of example illustrate various embodiments of this invention:

FIGS. 1 THROUGH 4

Figure 1:
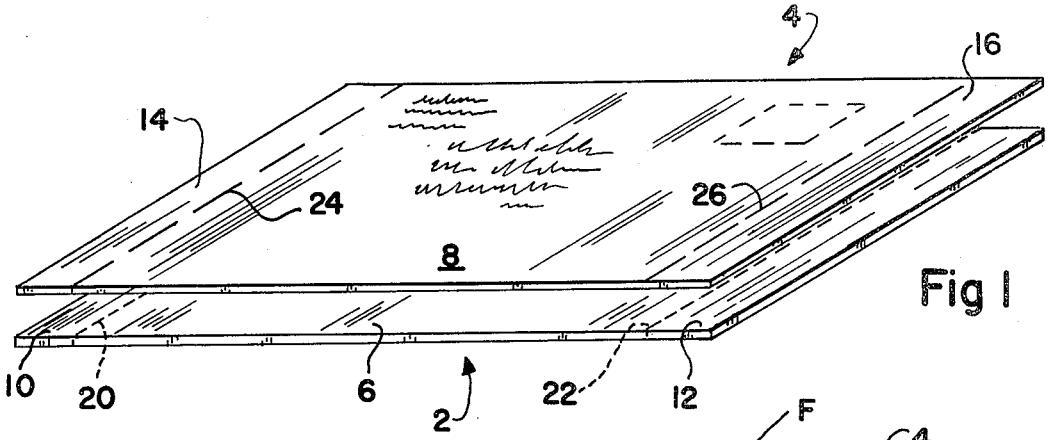
FIG. 1 is a perspective view showing the top and base members in spaced relationship prior to bonding.

FIG. 1 shows a composite tear-off postal receipt form similar to previously mentioned postal form PS Form 3811, April 1977 with a postage stamp area and return address section on one side, and an addressee section and delivery instruction section printed on the lower face (not shown), having a base member 2 and a top member 4 made from sheet material such as paper stock, kraft paper, or the like. The inside surface of the members 2 and 4 include a main portion 6 on the base member and a main portion 8 on the top member. Margin portions 10 and 12 are provided on the base member and 14 and 16 on the top member.

Figure 2:
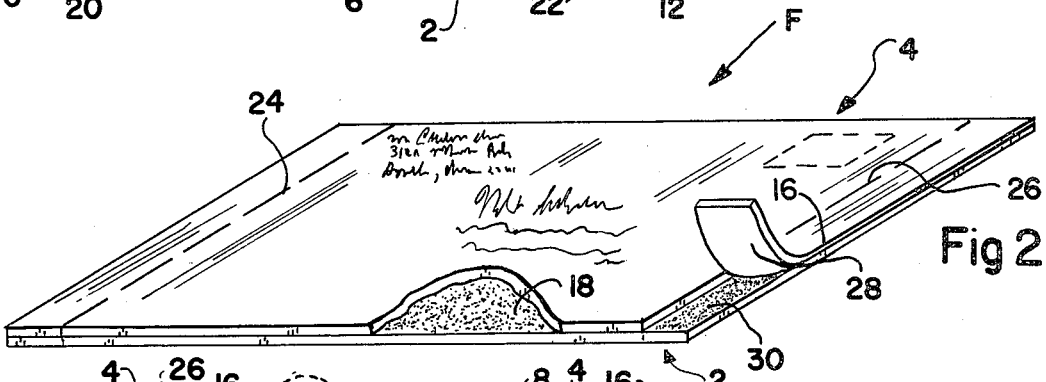
FIG. 2 is a perspective view showing the top and bottom members bonded together and showing a portion broken away to show the adhesive and a portion torn to show the tear-off strip.

Adhesive 18 as best shown in FIG. 2 may be applied to either the base member 2 or the top member 4 on the inside surface thereof or to both inside surfaces for the purpose bonding the main portions 6 and 8 together. The adhesive may extend across the entire form F at least on one inside surface. It may be pressure sensitive adhesive or some other type of adhesive at least as far the bonding aspect is concerned as will be discussed subsequently. The base member 2 is provided with perforations 20 and 22 adjacent the margins 10 and 12. The top member 4 is provided with slots 24 and 26 adjacent the margins 14 and 16. It will be obvious that the perforations may be slots or scoring of some type and for the purpose of this application the word perforations is intended to include both scoring and slotting or the like.

Figure 3:
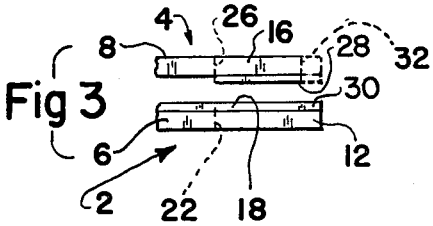
FIGS. 3 and 4 are enlarged fragmentary side elevational views showing the top and base members in spaced relation with adhesive and release material thereon.

Referring now to FIG. 3, which is an enlarged fragmentary section of the form F, main portion 6 is coated with adhesive 18 up to the perforation line 22. Margin 16 is coated with a release material 28 which may be of a silicon type composition, a mylar coat, etc. The top member 4 has no adhesive on the main portion 8. There is a pressure sensitive adhesive 30 on the margin 12. When the base member 2 and top member 4 are brought together, the release coat 28 is designed so as to permit removal of the margin 16 at the perforations 26. The margin 12 may be peeled back and then torn-off. This will expose the pressure sensitive adhesive 30 on the margin 12 permitting application of the form F to a package, envelope or the like. When it is desired to remove the main form F from the package, the slots 20 and 22 are ruptured and the form is torn away from the package leaving the margins 10 and 12 affixed thereto. The form can then be placed in the mail for return to sender.

It will be noted that a small portion 32 of the margin 16 may be removed to expose the edge portion of the margin 12 in order to better grasp this portion for peeling the release margin 12 from the glued margin 16.

Figure 4:
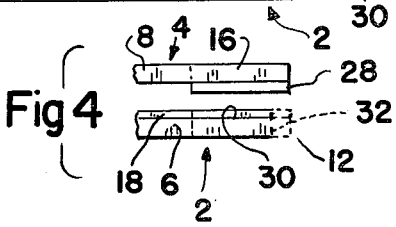

FIG. 4 shows an alternative configuration from that of FIG. 3 in which the adhesive 18 may be extend completely across the main portion 6 and the margin 12. The margin 12 may be coated with a different type of adhesive than the main portion 6 so long as pressure sensitive adhesive is applied to the margin 12. The top member 4 has no adhesive applied to its main portion 8 and has a release coat 28 applied to the margin 16 on the inside surface thereof engaging with the adhesive 18 which extends across the main portion 6 and the margin 12. As in FIG. 3, a small portion 32 may be removed in order to allow the thumb or fingernail to engage the edge portion of the margin 16 for peeling back the release margin 16 to expose the pressure sensitive adhesive 30 on the margin 12.

It should be noted that the form F may have printing on both the top and bottom outside surfaces such as an address, instructions, or the like. Once the main portions 6 and 8 which form the form F have been torn-off and removed from the package, they can be placed in the mail and returned to sender.

FIGS. 5 THROUGH 7

Figure 5:
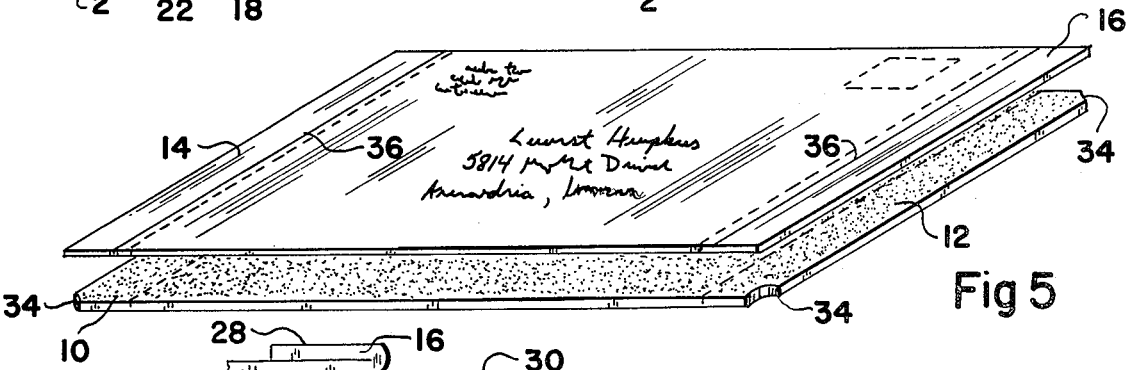
FIG. 5 is a perspective view of the top and base members in spaced relation showing a modification of the form.
Figure 7:
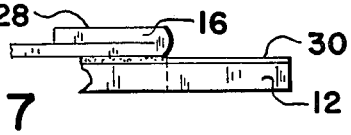
FIG. 7 is a fragmentary enlarged side elevational view showing the margin folded back.
Figure 6:
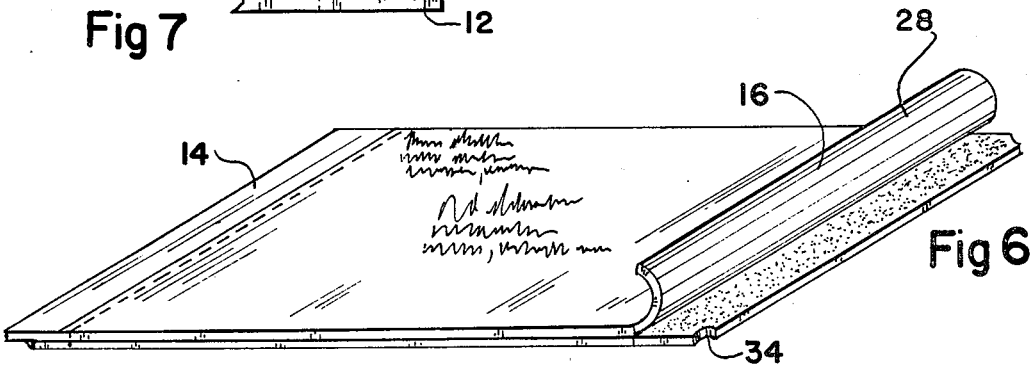
FIG. 6 is a perspective view showing the form of FIG. 5 with a margin peeled back.

FIG. 5 shows a modification of the form shown in FIGS. 1 through 4 in that the corner areas are cut away as at 34 to expose a portion of the upper margins 14 and 16 to permit easy removal of these margins to expose the pressure sensitive adhesive on the margins 10 and 12. Scoring 36 is provided in case it is desired to fold back the release margins 14 and 16 without tearing them off yet while being able to apply the pressure sensitive adhesive to a package. The relationship is best shown in FIG. 7 which shows the folding back of the margin 16 exposing the pressure sensitive adhesive 30 on the margin 12.

It will now be obvious that this particular form can be made on a standard machine which feeds either one or two sheets of paper to various coating rollers which would apply the glue to the center or main portions 6 and 8 as desired as well as applying adhesive and release coating to the respective margins 10, 12, 14 and 16 as required. The printing can all be done in one step and the cutting out of the corners or notches 34 as well as the perforating 20 and 22 or slotting 24 and 26 or scoring 36 can be carried out on standard equipment in a single run. The form can be made up of two sheets in which a single sheet is folded back on itself once and then cut as desired. It will thus be seen that standard equipment whether using a single sheet or two sheets which are bonded together will produce the form of this invention.

While this invention has been described as having a preferred design, it will be understood that it is capable of further modification. This application is, thereofre, intended to cover any variations uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A tear-off composite card for attachment to a support surface, comprising:

(a) a base member formed of a rectangular sheet of relatively light stock material including a rectangular main portion and an adjacent detachable margin portion, (b) a top member superposed on the base member and including a matching rectangular sheet of relatively light stock material of matching size with that of the base member and including a main portion and an adjacent detachable margin, (c) the main portions and the margin portions of the base member and the top member being the same size and disposed in superposed relation with respect to each other, (d) a layer of adhesive disposed between the superposed main portions of the base and top members to provide a single relatively thick and stiff composite card suitable for card use, (e) a layer of contact adhesive on the surface of one of the two superposed margin portions, (f) a layer of release material on the surface of the margin portion of the other of the two superposed members in contact with the contact adhesive, and (g) each of the margin portions being separable from its adjacent main portion by a weakened line, whereby the margin portion containing the release material can be peeled off the composite card to expose the contact glue surface on the opposing margin portion to permit affixing of the composite card to a package, and the subsequent removal of the composite card from the package when desired by tearing it free of the margin portion having the contact glue surface.

2. The tear-off composite card for attachment to a support of claim 1, wherein:

(a) the weakened line between the main and margin portions is a perforate line.

3. The tear-off composite card for attachment to a support surface of claim 2, wherein:

(a) a margin portion is disposed on each end of the main portions of both the top and base members.

4. The tear-off composite card for attachment to a support surface of claims 1, 2 or 3, wherein:

(a) a postage block and return address section is disposed on the upper surface of the top member, and (b) the margin portions on the base member have contact adhesive on their surfaces.

5. The tear-off composite card for attachment to a support surface of claim 1, including:

(a) means on one of the two superposed margin portions to facilitate separation thereof.

6. The tear-off composite card for attachment to a support surface of claim 5, wherein:

(a) the means for facilitating separation of the margin portions includes a notch at one corner of one of said two superposed margin portions.

* * * * *